US006277152B1

(12) United States Patent
Kyriazis et al.

(10) Patent No.: US 6,277,152 B1
(45) Date of Patent: Aug. 21, 2001

(54) PROCESS FOR FINISHING A TEXTILE AND FINISHING BATHS

(75) Inventors: Jean Kyriazis, Compiegne; Antonio Gelabert, Bouffemont-Moisselles; Didier Wilhelm, Issy-les-Moulineaux, all of (FR)

(73) Assignee: Clariant (France) S.A., Puteaux (FR)

( * ) Notice: Subject to any disclaimer, the term of this patent is extended or adjusted under 35 U.S.C. 154(b) by 0 days.

(21) Appl. No.: 09/362,563

(22) Filed: Jul. 28, 1999

(30) Foreign Application Priority Data

Jul. 31, 1998 (FR) ..... 98 09872

(51) Int. Cl.[7] ..... D06M 13/288; D06M 13/192

(52) U.S. Cl. ..... 8/127.1; 8/116.1; 252/8.86; 252/8.91

(58) Field of Search ..... 8/127.1, 116.1, 8/115.64; 252/8.86, 8.91

(56) References Cited

U.S. PATENT DOCUMENTS

| | | | |
|---|---|---|---|
| 4,088,678 | * | 5/1978 | Matt et al. . |
| 5,018,577 | * | 5/1991 | Pardue et al. . |
| 5,085,794 | * | 2/1992 | Kneller et al. . |
| 5,256,746 | | 10/1993 | Blankenship et al. . |
| 5,300,240 | * | 4/1994 | Wilhelm et al. . |
| 5,385,680 | * | 1/1995 | Didier et al. . |
| 5,496,477 | | 3/1996 | Tang et al. . |

FOREIGN PATENT DOCUMENTS

| | | |
|---|---|---|
| 0564346 | 10/1993 | (EP) . |
| 9534710 | 12/1995 | (WO) . |

* cited by examiner

*Primary Examiner*—Margaret Einsmann
(74) *Attorney, Agent, or Firm*—Browdy and Neimark

(57) ABSTRACT

Process for finishing a cellulose-based textile according to which the textile is treated using an aqueous finishing bath containing the following cross-linking composition as a cross-linking agent for cellulose:

a) 15–95 molar % of at least one maleic acid and hypophosphorus acid telomer of formula (I)

(I)

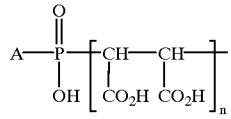

with

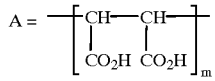

and (m+n)≧3
or A=H or OH and n≧2 b) 0–50 molar % phosphinicosuccinic acid
c) 0–40 molar % of phosphinicobissuccinic acid
d) 0–50 molar % phosphonosuccinic acid
e) 0–15 molar % hypophosphorus acid
f) 0–10 molar % phosphorus acid
g) 0–15 molar % phosphoric acid each of the acids a) to g) of the composition being able to be present either in free form or partially or totally neutralized in the form of an alkali metal or alkaline-earth metal ammonium or amine salt and finishing bath.

18 Claims, No Drawings

PROCESS FOR FINISHING A TEXTILE AND FINISHING BATHS

The present invention relates to a process for finishing a cellulose-based textile, a finishing bath comprising a cross-linking textile finish as well as a cellulose-based textile finished according to this process.

Cross-linking textile finishes are currently used for conferring on cellulose fabrics properties of resistance to creasing or crease recovery, a dimensional stability to domestic washes as well as easy care (easy ironing or no ironing), among other properties.

However, most of these cross-linking textile finishes contain free or combined formaldehyde which is released either in the finishing shop or when using fabrics finished in this way. However, formaldehyde is now considered to be a noxious product, exposure doses of which are limited to very low values by certain national regulations. Textile finishes free of any trace of formaldehyde were therefore actively sought.

Thus, the use of alkane polycarboxylic derivatives such as phosphono succinic acid as cross-linking agents for cellulose was proposed in the Patent Application EP-A-0484.196.

The International Application WO 96/26314 describes the use of maleic acid oligomers for treating cellulose fabrics in the presence of sodium hypophosphite as a cross-linking catalyst.

The Patents U.S. Pat. No. 5,496,476, U.S. Pat. No. 5,496,477, U.S. Pat. No. 5,705,475, U.S. Pat. No. 5,728,771, describe the combination of a phosphonoalkyl polycarboxylic acid with a second polycarboxylic acid which can be butanetetracarboxylic acid or, preferably, a polyacrylic acid of low mass, for cross-linking cellulose textiles in the presence of catalysts containing phosphorous such as sodium hypophosphite or sodium monophosphate.

The Patents U.S. Pat. No. 4,820,307, and U.S. Pat. No. 4,975,209, describe the treatment of cellulose materials by polycarboxylic acids, in particular butane tetracarboxylic acid or citric acid in the presence of catalysts of hypophosphite or phosphate type.

The cross-linking textile finishes mentioned above allow the use of or salting-out of formaldehyde to be avoided. However, their use requires the obligatory presence of a catalyst.

The Patent Application EP-A-0564.346 describes the use as a cross-linking textile finish of phosphinicosuccinic acid, phosphinicobisuccinic acid and their mixtures for finishing cellulose textiles. This type of finish can be used without a catalyst.

The Applicant carried out research with the aim of perfecting a process for finishing a cellulose-based textile which allows the use or salting-out of formaldehyde to be completely avoided and does not require the use of a catalyst, whilst conferring on the textiles properties of resistance to creasing or crease recovery, dimensional stability for domestic washes and very satisfactory easy care.

The Applicant then discovered with astonishment that a new cross-linking composition for cellulose had very useful cellulose cross-linking properties justifying its use as a textile finish, not containing and not salting-out formaldyde either in finishing shops or when using fabrics finished in this way.

The present invention thus consists of a process for finishing a cellulose-based textile, characterized in that the textile is treated using an aqueous finishing bath containing the following cross-linking composition as a cross-linking agent for cellulose:

a) 15–95 molar % of at least one maleic acid telomer and hypophosphorous acid of formula (I)

(I)

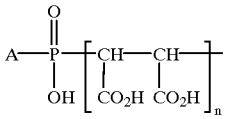

with

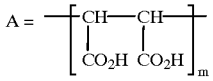

and $(m+n) \geqq 3$ or A=H or OH and $n \geqq 2$ b) 0–50 molar % phosphinicosuccinic acid c) 0–40 molar % phosphinicobisuccinic acid d) 0–50 molar % phosphonosuccinic acid e) 0–15 molar % hypophosphorous acid f) 0–10 molar % phosphorous acid g) 0–15 molar % phosphoric acid each of the acids a) to g) of the composition being able to be present either in free form or be partially or totally neutralized in the form of an alkali metal or alkaline-earth metal ammonium or amine salt.

The cross-linking composition used within the scope of the process according to the present invention is designated in what follows under the name of "cross-linking composition A".

A $^{31}$P NMR analysis revealed that one part of the telomeric fraction of formula (I) could contain several phosphorus atoms randomly distributed per chain.

The cross-linking composition A according to the invention can be prepared by radicular polymerization or telomerization.

This polymerization or telomerization is carried out using maleic acid and a telogenic monomer, preferably sodium hypophosphite. The molar ratio between the maleic acid and the telogenic monomer is generally comprised between 1.5 and 5, preferably between 2 and 4 and very particularly between 2.1 and 3.

The polymerization is initiated by a radicular catalyst, preferably sodium persulphate at doses which can be comprised between 5 and 12% by weight in relation to the weight of monomers.

Firstly, the polymerization can be carried out at temperatures comprised between 50 and 110° C., preferably between 70 and 85° C. The duration of the polymerization is generally comprised between 2 and 12 hours, preferably between 6 and 8 hours. Secondly, the polymerization is prolonged by a thermal treatment at a higher temperature, preferably between 80 and 90° C., for one period which can be comprised between 1 and 3 hours so as to complete the polymerization and destroy all residual trace of the initiator.

Different processes can be used for the polymerization, such as for example, addition of the initiator into the mixture of monomers.

The polymerization can be carried out under an inert atmosphere, for example under a nitrogen atmosphere.

After the polymerization is finished, oxidation of the P-H functions still available into P-OH functions can be carried out by an oxidizing agent, preferably hydrogen peroxide.

With regard to the prior art, the Applicant discovered with astonishment that the combination of 15 to 95 molar % of a telomer of maleic acid and hypophosphorus acid of formula (I) with a cross-linking composition containing phosphinicosuccinic acid phosphinobissuccinic acid and phosphonosuccinic acid as the major quantity and hypophosphorus acid, phosphorus acid and phosphoric acid as the minor quantity, allowed good quality finishing of cellulose-base textiles not containing and not salting-out formaldehyde either in finishing shops or when using fabrics finished in this way, to be obtained without the addition of a catalyst.

However, the use of an esterification catalyst or a mixture of several esterification catalysts allows the performances obtained on the treated fabric to be increased at a given temperature, or a given qualified level to be preserved by lowering the thermal conditions required for cross-linking.

The catalysts can be chosen from known esterification catalysts such as, by way of example, cyanamide, guanidine or one of its salts, dicyandiamide, urea, dimethylurea or thiourea, alkali metal salts of hypophosphorus, phosphorus or phosphoric acids, mineral acids, organic acids or their salts.

Preferred catalysts consist of cyanamide, dicyandiamide, urea, dimethylurea, sodium hypophosphite or their mixtures.

Under preferential conditions for implementing the invention, the cross-linking composition A of the invention comprises 15 to 95 molar % of a telomer of maleic acid and hypophosphorus acid, preferably 30 to 70 molar % and more particularly between 40 to 60 molar %.

The finishing bath used within the scope of the present invention comprises in general 3 to 30% by weight of the cross-linking composition A in solution in water.

The finishing bath containing the cross-linking composition A is preferably partially neutralized with an alkali metal hydroxide in order to obtain an aqueous finishing bath with a pH of 0.5 to 7, especially 1 to 7, preferably 1.5 to 5 and more particularly 2 to 3.5.

Under other preferred conditions for implementing the invention, no catalyst is added to the finishing bath. In fact, we noted that the cross-linking composition A self cross-links the cellulose, which is proven by Examples 12 to 18 which follow the description of the invention.

Under other preferred conditions of the invention, the finishing bath contains a wetting agent which is advantageously an ethoxylated nonylphenol, quite particularly nonylphenol ethoxylated with 10 moles of ethylene oxide. Baths of this type are described in Examples 12 to 30 which follow.

Under other preferred conditions of the invention, one or more cellulose esterification catalysts are added to the finishing bath, preferably chosen from cyanamide, dicyandiamide, urea, dimethylurea or sodium hypophosphite.

According to another aspect of the invention, a subject of this is also a finishing bath for a cellulose-based textile characterized in that it comprises a cross-linking composition A as defined above in aqueous solution, this bath having a pH comprised between 0.5 and 7, especially 1 to 7, as well as a wetting agent.

A subject of the present Application is also the finished cellulose-based textile, characterized in that it is obtained by implementing the process described above.

A subject of the present Application is also the use of the cross-linking composition A described above as a cross-linking agent for cellulose.

The following examples are given as an indication, they allow the invention to be better understood but do not limit the scope.

In these examples:

the crease recovery test is carried out according to the AATCC 66-1972 standard on samples which are treated but not washed, called samples as then are, and on the samples subjected to three domestic washes at 60° C.; the crease recovery is expressed by the sum of the angles of crease recovery obtained in the direction of the warp and in the direction of the weft.

the resistance to the traction of the samples expressed in daN in the direction of the weft is carried out according to the AFNOR G 07.001 standard.

the whiteness, expressed in degrees Berger, is measured with a spectrophotometer. The level of residual formaldehyde on the fabric was determined according the method described in the Japanese Law 112-1973.

EXAMPLE 1

A solution containing 781 g maleic acid (6.73 moles), 237 g of sodium hypophosphite (2.69 moles) and 840 g water is prepared in a 2-litre reaction vessel. The mixture is maintained at 75° C. and 265 g of a solution of 36.7% sodium persulphate is added over 6 hours. Polymerization is completed in a 2-hour stage at 85° C. 2002 g of a slightly coloured limpid solution, characterized by phosphorus 31 NMR and the molar composition of which is indicated in Table 2 is obtained.

EXAMPLES 2 to 5

Examples 2 to 5 are prepared according to an operating method identical to that described in Example 1 by varying the maleic acid/sodium hypophosphite ratio from 1.5 to 4 and by modifying the polymerization conditions as described in Table 1.

TABLE 1

| Example | Molar ratio AM/HPS | Polymerization conditions |
|---|---|---|
| 2 | 2 | 6 h at 75° C. + 2 h at 85° C. |
| 3 | 3 | 8 h at 75° C. + 2 h at 85° C. |
| 4 | 1.5 | 6 h at 75° C. + 2 h at 85° C. |
| 5 | 4 | 11 h at 75° C. + 2 h 30 at 85° C. |

The molar compositions of the products obtained are indicated in Table 2.

EXAMPLE 6

A mixture of 100 g of the composition of Example 4 and 12.3 g hydrogen peroxide at 33% is heated at 70° C. for one hour. The molar composition is indicated in Table 2.

EXAMPLE 7

A mixture of 200 g of the composition of Example 2 and 15.2 g hydrogen peroxide at 33% is heated at 80° C. for 9 hours. The molar composition is indicated in Table 2.

EXAMPLE 8

A mixture of 200 g of the composition of Example 1 and 8.3 g of hydrogen peroxide at 33% is heated at 80° C. for 9 hours. The molar composition is indicated in Table 2.

TABLE 2

| Ex | Molar ratio AM/HPS | Active material % | Process | TEL. | PBSA | PISA | PSA | HPX | PHX | PHQ |
|---|---|---|---|---|---|---|---|---|---|---|
| 1 | 2.5 | 52.8 | PSS in AM + HPS | 52.3 | 21.5 | 20.2 | 1.9 | 0.9 | 3.2 | 0 |
| 2 | 2 | 48.6 | PSS in AM + HPS | 35.8 | 17.9 | 35.2 | 0.4 | 8.9 | 1.8 | 0 |
| 3 | 3 | 55.1 | PSS in AM + HPS | 63.8 | 12.8 | 18.1 | 1.3 | 0 | 4 | 0 |
| 4 | 1.5 | 42.8 | PSS in AM + HPS | 24.8 | 13.8 | 46.6 | 1.8 | 9.9 | 3.1 | 0 |
| 5 | 4 | 41.5 | PSS in AM + HPS | 75 | 7.4 | 4.1 | 4.7 | 0 | 8.8 | 0 |
| 6 | 1.5 | 38.1 | Oxidation of Ex 4 | 20.6 | 12.6 | 6.6 | 43.8 | 0 | 8.4 | 8 |
| 7 | 2 | 45.2 | Oxidation of Ex 2 | 35.6 | 18.3 | 3.3 | 32.5 | 0 | 4.9 | 5.4 |
| 8 | 2.5 | 50.7 | Oxidation of Ex 1 | 50.2 | 21.4 | 1.6 | 21.5 | 0 | 4.6 | 0.7 |

AM: Maleic acid
HPS: Sodium hypophosphite
PSS: Sodium persulphate
TEL: Maleic acid/hyposphorous acid telomer
PBSA: Phosphinicobisuccinic acid
PISA: Phosphinicosuccinic acid
PSA: Phosphono succinic acid
HPX: Hypophosphorus acid
PHX: Phosphorus acid
PHQ: Phosphoric acid

COMPARISON EXAMPLE 9

The comparison example is prepared according to an operating method analogous to that described in Example 1 with a molar ratio of maleic acid/sodium hypophosphite of 1. The product obtained (active material=33.9 has the following molar composition: 12.3% TEL, 7.3% PBSA, 48.9% PISA, 0.7% PSA, 25.3% HPX and 5.5% PHX.

COMPARISON EXAMPLE 10

This is an sodium polymaleate oligomer at 49.1% by weight in water provided by Coatex under the reference AM 508 C.

COMPARISON EXAMPLE 11

The applicable properties of a non-treated fabric are determined after illustrating the positive impact of cross-linking (crease recovery as is and after three domestic washes at 60° C.) and monitoring the preservation during treatment of properties such as resistance to traction and whiteness (Tables 3 and 4).

EXAMPLES 12 to 20

Properties of Fabrics Treated with Compositions Without a Catalyst.

A fabric of 100% coffon poplin, scoured and bleached with a weight of approximately 130 g per square metre with an expression rate of 75% is impregnated on a padding machine in an aqueous bath containing the cross-linking compositions as well as 2 g/l of nonylphenol ethoxylated with 10 moles of ethylene oxide and the pH of which is adjusted to 2.5 with soda (the pH of the bath of Example 20 is adjusted to 2.5 with sulphuric acid). The fabric is then dried for 45 seconds at 120° C., then it is subjected to a thermal treatment of 30 seconds at 180° C. on a laboratory stenter.

The quantities of each cross-linking agent are calculated for equal active materials and the baths do not contain an esterification catalyst. The applicable properties are indicated in Table 3.

TABLE 3

| Ex | cross-linking | dose (g/l) | DEF | D3L | RST | ΔBLC |
|---|---|---|---|---|---|---|
| 11 | non-treated fabric | — | 172 | 187 | 43 | 0 |
| 12 | Example 1 | 138 | 232 | 226 | 30.5 | 1.2 |
| 13 | Example 2 | 150 | 232 | 220 | 25.1 | 0.7 |
| 14 | Example 3 | 131 | 227 | 222 | 29.3 | 1.7 |
| 15 | Example 4 | 170 | 227 | 218 | 28.1 | 0.2 |
| 16 | Example 5 | 170 | 222 | 220 | 32.7 | 2.8 |
| 17 | Example 7 | 158 | 220 | 204 | 30.7 | 0.4 |
| 18 | Example 8 | 144 | 220 | 208 | 30.1 | 1.1 |
| 19 | comparison example 9 | 214 | 218 | 219 | 34.3 | 0.3 |
| 20 | comparison example 10 | 148 | 205 | 202 | 27.5 | 0 |

DEF: crease recovery as is according to the AATCC 66-1972 standard (unit: degree of angle)
D3L: crease recovery after 3 domestic washes at 60° C. (unit: degree of angle)
RST: resistance to traction in the direction of the weft according to the AFNOR G 07.001 standard (unit: daN)
ΔBLC: loss of whiteness compared to non-treated fabric (unit: degree of Berger whiteness)

It is noted that the compositions according to the inventions have good applicable properties in the absence of a catalyst since the level of crease recovery obtained without a catalyst is clearly greater than that of non-treated fabric (comparison example 11) and also greater than that of the maleic acid oligomer (comparison example 20).

The crease recovery level increases to a certain point with the molar percentage of telomer (I) present in the compositions. With the comparison example 19 based on the composition of comparison example 9 which only contains 12.3 molar % of telomer (1), the crease recovery as is (DEF) is less than that obtained for higher percentages of telomer (I).

The optimum crease recovery as is, is situated between 35 and 55 molar % telomer (I) as shown with Examples 12 and 13.

The permanence of treatment illustrated by the crease recovery after three domestic washes at 60° C. is good. A good preservation of mechanical properties as indicated by negligible losses of resistance of treated fabric without significant loss in the level of whiteness is also observed.

The presence of formaldehyde could not be detected in any of the fabrics corresponding to the examples of Table 3.

It is known that the presence of sodium hypophosphite in textile treatment baths has a negative impact on the behavior of the fabrics coloured with reactive colorants or sulphur colorants leading to changes of shade. It was able to be calculated that the cross-linking compositions obtained by telomerization of maleic acid and sodium hypophosphite in a ratio greater than or equal to 2.5 does not contain or contains very little sodium hypophosphite and therefore does not have this type of drawback.

EXAMPLES 21 to 30

Properties of Fabrics Treated with the Cross-linking Compositions and with a Catalyst.

A fabric of 100% cotton poplin, scoured and bleached, with a weight of approximately 130 g per square metre with an expression rate of 75% is impregnated on a padding machine in an aqueous bath containing the compositions of examples 1 to 10, with 30 g/l of dicyandiamide as a catalyst as well as 2 g/l of nonylphenol ethoxylated with 10 moles of ethylene oxide and the pH of which is adjusted to 2.5 with soda. The fabric is then dried for 45 seconds at 120° C., then it is subjected to a thermal treatment of 30 seconds at 180° C. on a laboratory stenter.

The quantities of each cross-linking agent are calculated for equal active ingredients. The applicable properties are indicated in Table 4.

TABLE 4

| Ex | cross-linking | dose (g/l) | DEF | D3L | RST | ΔBLC |
|---|---|---|---|---|---|---|
| 11 | non-treated fabric | — | 172 | 187 | 43 | 0 |
| 21 | Example 1 | 138 | 259 | 236 | 26.7 | −2.6 |
| 22 | Example 2 | 150 | 252 | 239 | 30.1 | −2.2 |
| 23 | Example 3 | 131 | 254 | 237 | 31 | −2.3 |
| 24 | Example 4 | 170 | 243 | 230 | 29.2 | −1.6 |
| 25 | Example 5 | 170 | 246 | 239 | 32.5 | −5.4 |
| 26 | Example 6 | 190 | 237 | 221 | 35 | −3 |
| 27 | Example 7 | 158 | 253 | 231 | 32.3 | −1.1 |
| 28 | Example 8 | 144 | 245 | 232 | 31.4 | −1.6 |
| 29 | comparison example 9 | 214 | 240 | 225 | 35.6 | −1.6 |
| 30 | comparison example 10 | 148 | 222 | 222 | 32.8 | −0.9 |

With 30 g/l of dicyandiamide, the crease recovery properties as are, are greater than in the absence of an esterification catalyst and increase up to a certain point with the molar percentage of telomer (I). The optimum %) crease recovery as is, is situated between 35 and 65 molar % of telomer (I) as shown by Examples 21, 22 and 23.

The level of crease recovery obtained with the compositions according to the invention in combination with the catalyst is clearly greater than that obtained with maleic acid oligomer (comparison example 30).

With the esterification catalyst, the permanence of the treatment illustrated by the crease recovery after three domestic washes at 60° C. is equally good. A good preservation of mechanical properties as indicated by negligible losses of resistance of the treated fabrics is also observed. In general, no loss of significant whiteness with regard to the non-treated fabric is observed.

The presence of formaldehyde was not able to be detected in any fabrics corresponding to the examples of Table 4.

EXAMPLES 31 to 34

By using the same operating conditions than those of the examples 21 to 30, by using the aqueous bath containing the composition of the example 1, and by using other catalysts than dicyandiamide, the following results were obtained and are reported in table 5.

TABLE 5

| | Amount of catalyst used in g/l | DEF | RST |
|---|---|---|---|
| Ex. 31 | 30 g/l dimethylurea | 244 | 30,9 |
| Ex. 32 | 10 g/l urea | 238 | 27,8 |
| Ex. 33 | 7 g/l dimethylurea + 5 g/l urea | 245 | 31,5 |
| Ex. 34 | 20 g/l sodium hypophosphite | 249,5 | 28,4 |

What is claimed is:

1. In a process for finishing a cellulose-based textile, characterized in that the textile is treated using an aqueous finishing bath containing a cross-linking composition as a cross-linking agent for cellulose, the improvement wherein said cross-linking agent comprises (a) 15–95 molar % of at least one malaic acid and hypophosphorous acid telomer of formula (I)

(I)

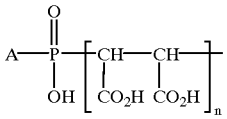

with

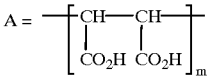

and (m+n)≧3 or A=H or OH and n≧2, with the remainder to 100% being (b) 0–50 molar % phosphinosuccinic acid (c) 0–40 molar t phosphinobissuccinic acid (d) 0–50 molar % phosphonosuccinic acid (a) 0–15 molar % hypophosphorus acid (f) 0–10 molar % phosphorus acid (g) 0–15 % phosphoric acid each of the acids (a) to (g) of the composition being able to be present either in free form or partially or totally neutralized in the form of an alkali metal or alkaline-earth metal, ammonium or amine salt.

2. Process according to claim 1, characterized in that the cross-linking composition contains 30 to 70 molar % of at least one maleic acid and hypophosphorus acid telomer of formula (I).

3.Process according to claim 1, characterized in that the cross-linking composition contains 40 to 60 molar % of at least one maleic acid and hypophosphorus acid telomer of formula (I).

4. Process according to any one of claim 1, characterized in that no esterification catalyst is added to the finishing bath.

5. Process according to any one of claims 1, characterized in that one or more esterification catalysts are added to the finishing bath.

6. Process according to claim 5, characterized in that the esterification catalyst is cyanamide, guanidine or one of its salts, dicyandiamide, urea, dimethylurea or the alkali metal salts of hypophosphorus, phosphorus or phosphoric acids, mineral acids, organic acids or one of their salts.

7. Process according to one of claim 1, characterized in that said cross-linking composition is capable of being obtained by radicular polymerization of maleic acid and sodium hypophosphite in a molar ratio between 1.5 and 5, said polymerization being carried out firstly at a temperature between 70 and 85° C., followed secondly by a thermal treatment at a temperature between 80 and 90° C. with the aim of completing said polymerization.

8. Process according to claim 7, characterized in that the molar ratio between the maleic acid and sodium hypophosphite is between 2 and 4.

9. Process according to claim 7, characterized in that the molar ratio between the maleic acid and sodium hypophosphite is between 2.1 and 3.

10. A cellulose-based textile, finished by the process of claim 3.

11. A cellulose-based textile, finished by the process of claim 8.

12. A finishing bath for cellulose-based textiles, comprising an aqueous finishing bath containing a wetting agent and a cross-linking composition, said cross-linking composition comprising (a) 15–95 molar % of at least one maleic acid and hypophosphorous acid telomer of formula (I)

(I)

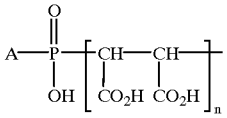

with

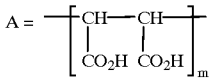

and (m+n)≧3 or A=H or OH and n≧2, with the remainder of said cross-linking agent to 100% being (b) 0–50 molar % phosphinosuccinic acid (c) 0–40 molar % phosphinobissuccinic acid (d) 0–50 molar % phosphonosuccinic acid (e) 0–15 molar % hypophosphorus acid (f) 0–10 molar % phosphorus acid (g) 0–15 % phosphoric acid each of the acids (a) to (g) of the composition being able to be present either in free form or partially or totally neutralized in the form of an alkali metal or alkaline-earth metal, ammonium or amine salt.

13. Finishing bath according to claim 12, characterized in that the wetting agent is an ethoxylated nonylphenol.

14. Finishing bath according to claim 13, wherein said ethoxylated nonylphenol is ethoxylated with 10 moles of ethylene oxide.

15. Finishing bath according to claim 12, having a pH between 2 and 3.5.

16. Finishing bath according to claim 15, characterized in that the wetting agent is an ethoxylated nonylphenol.

17. Finishing bath according to claim 16, wherein said ethoxylated nonylphenol is ethoxylated with 10 moles of ethylene oxide.

18. A cellulose-based textile, finished with an aqueous finishing bath having an acid pH containing 3–30% by weight of a cross-linking composition, said cross-linking composition comprising (a) 15–95 molar % of at least one maleic acid and hypophosphorous acid telomer of formula (I)

(I)

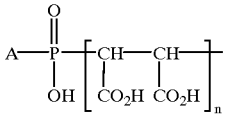

with

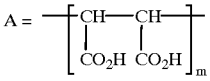

and (m+n)≧3 or A=H or OH and n≧2, with the remainder of said cross-linking agent to 100% being (b) 0–50 molar % phosphinosuccinic acid (c) 0–40 molar % phosphinobissuccinic acid (d) 0–50 molar % phosphonosuccinic acid (e) 0–15 molar % hypophosphorus acid (f) 0–10 molar % phosphorus acid (g) 0–15 % phosphoric acid each of the acids (a) to (g) of the composition being able to be present either in free form or partially or totally neutralized in the form of an alkali metal or alkaline-earth metal, ammonium or amine salt.

* * * * *